United States Patent [19]

Scharfenberger

[11] 4,403,736

[45] Sep. 13, 1983

[54] UNCONTAMINATED PURGE SOLVENT RECOVERY SYSTEM

[75] Inventor: James A. Scharfenberger, Indianapolis, Ind.

[73] Assignee: Ransburg Corporation, Indianapolis, Ind.

[21] Appl. No.: 389,695

[22] Filed: Jun. 18, 1982

Related U.S. Application Data

[63] Continuation of Ser. No. 326,151, Nov. 30, 1981, Pat. No. 4,350,720, which is a continuation-in-part of Ser. No. 228,166, Jan. 26, 1981, Pat. No. 4,311,724, and Ser. No. 275,872, Jun. 22, 1981, Pat. No. 4,348,425.

[51] Int. Cl.[3] ..... B05B 15/02; B05B 7/16; F23D 11/34; F23D 13/28

[52] U.S. Cl. ..... 239/112; 118/302

[58] Field of Search ..... 118/688, 692, 50, 50.1, 118/302; 427/8, 401, 421, 445; 239/112

[56] References Cited

U.S. PATENT DOCUMENTS

| | | | |
|---|---|---|---|
| 3,348,774 | 10/1967 | Wiggins | 239/70 |
| 3,385,522 | 5/1968 | Kock | 118/302 X |
| 3,605,683 | 9/1971 | Wiggins | 118/8 |
| 3,674,205 | 7/1972 | Kock | 239/112 X |
| 3,857,513 | 12/1974 | Wiggins | 239/112 X |
| 3,870,233 | 3/1975 | Wilhelm et al. | 239/112 X |
| 4,083,493 | 4/1978 | Wiggins | 239/112 |
| 4,230,270 | 10/1980 | Poret | 239/112 X |
| 4,263,091 | 4/1981 | King | 239/112 X |
| 4,311,724 | 1/1982 | Scharfenberger | 427/8 |
| 4,337,282 | 6/1982 | Springer | 118/302 X |

*Primary Examiner*—Michael R. Lusignan
*Attorney, Agent, or Firm*—Barnes & Thornburg

[57] ABSTRACT

A recovery system for solvent used to clean coating material from a multiple-color coating material dispensing system which undergoes frequent color changes includes a vacuum source over the recovered solvent in a recovery tank. The system is switched during the color change cycle from a mode in which solvent is dispensed to clean a pre-change color from a dispensing device to a mode in which the vacuum withdraws solvent remaining in a solvent delivery line to the dispensing device into the recovery tank. Solvent usage, disposal of discarded solvent, and other environmental considerations are salutarily affected.

5 Claims, 8 Drawing Figures

UNCONTAMINATED PURGE SOLVENT RECOVERY SYSTEM

This is a continuation of application Ser. No. 06/326,151 filed Nov. 30, 1981, now U.S. Pat. No. 4,350,720; patented Sept. 21, 1982.

U.S. patent application Ser. No. 326,151 is a continuation-in-part of previously filed, co-pending U.S. patent application Ser. No. 228,166, filed Jan. 26, 1981, now U.S. Pat. No. 4,311,724; patented Jan. 19, 1982, and co-pending U.S. patent application Ser. No. 275,872, filed June 22, 1981, now U.S. Pat. No. 4,348,425; filed Sept. 7, 1982, both assigned to the same assignee as the present invention.

This invention relates to coating and finishing equipment, and particularly to automatic coating equipment which experiences frequent changes in the characteristics of the coating materials being dispensed, such as, automatic coating equipment on an automobile paint line where coating material colors are changed ordinarily from one automobile to the next.

A standard technique used in the automotive finishing industry, where automatic coating equipment dispenses finish onto automobiles in an essentially assembly line fashion, and where color changes are frequent, occurring ordinarily from one automobile to the next, is to use solvent at a relatively low superatmospheric pressure to flush the last of a quantity of finish of a given color from the automatic coating equipment coating material delivery tube to the coating material atomizing and dispensing device. This technique is used to prevent the contamination of the new coating material which is to be dispensed through the feed tube with the old coating material which remained in the feed tube at the end of the immediately preceding dispensing cycle.

A problem which has always attended the use of this so-called "solvent flush" is that typically the feed tubes which supply solvent for cleaning various parts of the atomizing device, such as the hub and the outside surfaces of a rotating atomizing device, can extend for some distance, and thus have capacities of several ounces of solvent. These components of the system are filled with solvent during each color change, then may be "blown down" or emptied of solvent using high-pressure air prior to introduction of the next color into the system. Since only the solvent which is actually disposed onto the atomizing device hub and exterior will be contaminated by coating material remaining from the previous coating operation, a quantity of uncontaminated solvent can be discarded unnecessarily during each color change cycle. In an operation such as an automobile body finishing operation, several hundred such color change cycles can occur in a single day. This results in a tremendous waste of solvent. The solvents are typically quite expensive. Additionally, the solvents usually are highly volatile and must be dealt with accordingly due to environmental and safety considerations, both inside the finishing facility and in the air which invariably escapes from the facility to the outside. Finally, the solvents must be processed or packaged for suitable disposal so that they do not present a threat to the environment. It will be immediately appreciated that a reduction in the quantity of solvent used in such an operation would be of substantial benefit from an economic standpoint, a safety standpoint, and from an environmental or ecological standpoint.

Alternatively, if a blow-down is not used between color change operations, solvent remains in these lines which lead to solvent jets in close proximity to the atomizing device. This solvent has a tendency to drip from the jets between color change operations. This can be disadvantageous, particularly where the dispensing device is an overhead dispensing device for dispensing coating material onto, for example, the top of an automobile on an automobile finish application line.

According to the invention, a method and apparatus are provided for recovery of unused or uncontaminated solvents in such a system.

The invention may best be understood by referring to the following description and accompanying drawings which illustrate the invention. In the drawings.

Figure 1:
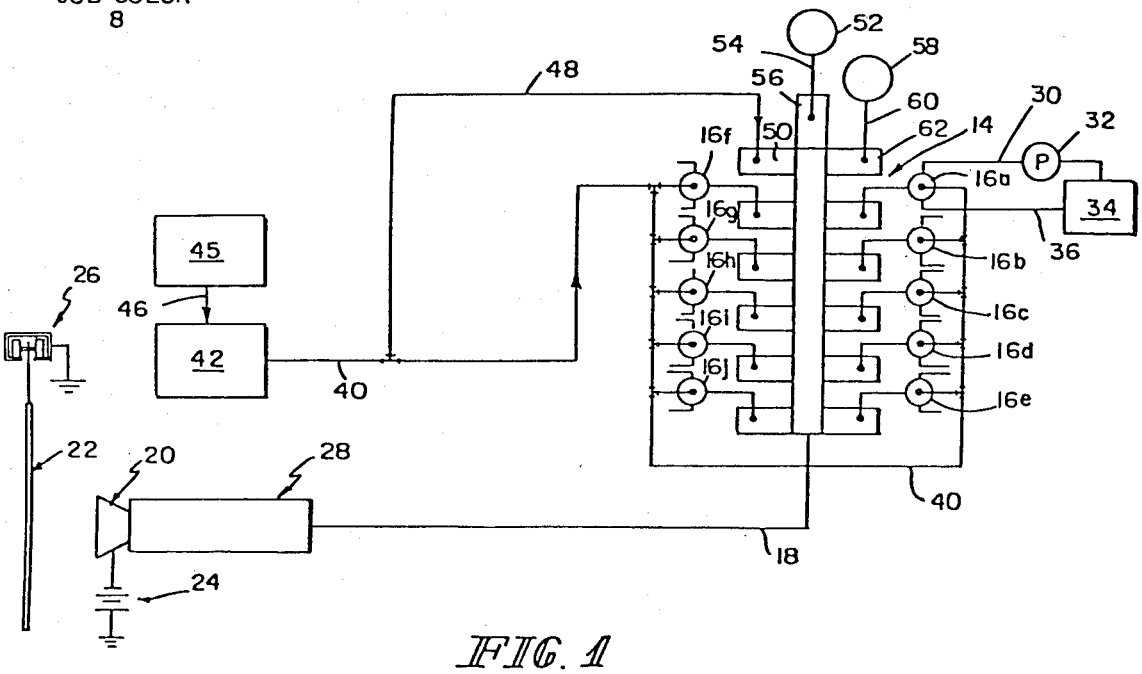
FIG. 1 is a partly block and partly schematic diagram of a single atomizing device and associated coating material color control system for dispensing any one of ten different coating materials having different characteristics.

Turning now to FIG. 1, a ten-color manifold 14 controls the flow of coating materials from each of ten different sources (only one of which is shown) through ten independently operated pressure control valves 16*a–j* to a single feed tube 18. Feed tube 18 is coupled to an atomizing and dispensing device 20 of known construction (see, for example, U.S. Pat. No. 4,148,932). From device 20, a selected one of the ten colors is dispensed in atomized fashion and deposited upon a target 22 to coat it.

As illustrated diagrammatically, the atomizing and dispensing device 20 is typically held at a high-magnitude potential by an electrostatic potential supply 24. Target 22 is typically one of a number of targets which are conveyed serially past the stationary, or relatively stationary, atomizing and dispensing device 20 on a conveyor 26. Feed tube 18 typically is electrically nonconductive, and the device 20 is typically supported from an insulating column 28 to minimize leakage of electrostatic potential from device 20 to ground. This ensures that a maximum amount of electrostatic charge is available to charge atomized and dispensed particles of coating material, which then migrate under the influence of the electric field established between device 20 and the grounded target 22.

Turning now more specifically to the construction of the manifold 14 and its associated components, and with reference to valve 16*a*, each of valves 16*a*–16*j* includes a coating material delivery line 30 which is coupled through a pump 32 to a coating material source 34. Each valve 16*a–j* also includes a recirculating line 36 through which coating material delivered through line 30 by pump 32 from source 34 is recirculated to source 34 when the valve 16*a–j* is in the recirculate position. Although only one delivery system 30, 32, 34, 36 for coating material to a valve (16*a*) is shown, it is understood that each of valves 16*a–j* has such a system for a different coating material associated with it. Valves 16*a–j* can be of the types illustrated in, for example, U.S. Pat. No. 3,334,648.

The pressures of the various coating materials delivered from the various sources 34 to the various valves 16*a–j* are regulated through a common low-pressure air line 40 from an electrical signal-to-air pressure transducer and volume booster 42.

The input signal to electrical signal-to-air pressure transducer and volume booster 42 is provided by an electrical signal output of a program control device 45 of the type described in U.S. patent application Ser. No. 35,105, titled ANALOG PAINT OUTPUT CONTROL, and assigned to a subsidiary of the assignee of the present invention. A brief description of the program control device 45 will suffice for purposes of explanation. The program control device is programmable to provide electrical output signals which actuate respective valves 16*a–j* in accordance with the desired coating materials to be dispensed upon respective targets 22 as the targets are conveyed along the conveyor 26 past device 20. That is, the program which is stored in the program control device 45 and which controls the operation of the system illustrated in FIG. 1 actuates individual valves 16*a–j* to open and close as targets 22 to be painted by the various colors dispensed through valves 16*a–j* appear before device 20. In addition to providing this electrical control of valves 16*a–j*, the program control device includes stored information relative to the characteristics of each of such coating materials, and calls up the stored information relative to the characteristics of a particular coating material dispensed by a particular valve 16*a–j*, as that particular valve 16*a*–16*j* is actuated to dispense its respective coating material. This information relative to characteristics appears as a direct-current electrical signal on line 46. Typically, each of the coating materials to be dispensed by a respective valve 16*a–j* has associated with it a different DC voltage level on line 46. Typically, these DC voltage levels on line 46 are generated by closing of respective switches within the program control device, in accordance with the program stored therein, to couple different DC voltage supplies, or a single voltage supply through the various steps of a resistive voltage divider within the program control device, to line 46. In any event, the different DC voltage levels appearing on line 46 correspond to respective different pressures in low-pressure air line 40 and different pressures in the coating materials dispensed from respective valves 16*a–j* into the ten-color manifold 14.

As an example, let it be assumed that valve 16*b* is coupled to a source of a green-colored coating material. Let it further be assumed that pressure-control valve 16*c* controls the supply of a blue-colored coating material to manifold 14. Let it be assumed that the green-colored material has a higher viscosity. It is apparent that, if a soft air push is used to move these coating materials through the manifold 14 and feed tube 18 near the end of a coating cycle of a green-coated target 22 and a blue-coated target 22, respectively, a slightly higher soft air pressure will be required to deliver the green material to device 20, and a slightly lower soft air pressure will be required to deliver the blue material to device 20 at the same rate. These necessary adjustments are made in the air pressure delivered to air line 48 to a soft air supply control valve 50 mounted on manifold 14.

After the target 22 to be coated has passed device 20, and a color change is to be made, solvent from a solvent supply 52 is provided through a solvent supply line 54 and a solvent supply valve 56 to manifold 14 to flush any coating material remaining in manifold 14, feed tube 18, and device 20 from these components so that this color will not contaminate the next color to be dispensed through manifold 14. So that the solvent does not affect the viscosity of the next coating material, particularly during the early stages of the dispensing process for the next coating material, the solvent is dried using high-pressure air provided by a supply 58 through a high-pressure air supply line 60 and a high-pressure air supply valve 62 on manifold 14.

Figure 2:
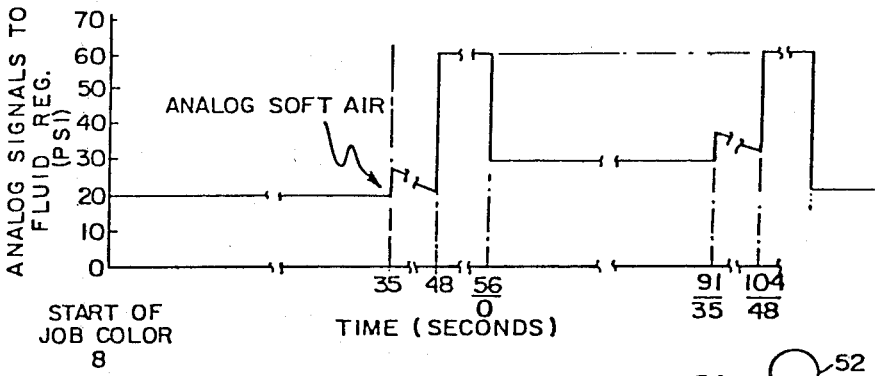
FIG. 2 is a time chart which illustrates portions of typical color-change cycles.

An example of a color change cycle with the system illustrated in FIG. 1 is illustrated in FIG. 2. During the time interval from 0 to 35 seconds, a first color is being dispensed at a line 40 pressure of about 20 p.s.i.a. ($1.38\times10^6$ dynes/cm$^2$). Toward the end of the interval during which the first color is to be dispensed, valve 50 is actuated and air at a slightly higher pressure (e.g., 25 p.s.i.a.—$1.72\times10^6$ dynes/cm$^2$) is supplied through line 48 and valve 50 to push the end of the first color from manifold 14 through feed tube 18 to device 20. The rate of flow of the first coating material is maintained substantially constant throughout this interval, even though no more coating material is being supplied through a respective valve 16*a–j* to manifold 14. Since the remaining "slug" of coating material in the feed tube 18 is becoming continuously smaller, reducing its resistance to flow, this substantially constant flow is achieved by employing a "ramp" air signal which starts at 25 p.s.i.a. and reduces to a somewhat lower pressure, e.g., 21 p.s.i.a. toward the end of the soft air push interval. Some other declining value signal, such as a "staircase" signal, can also be used. These signals are capable of being generated. Electronic ramp and staircase generators of known types can be incorporated into program control device 45 to drive electrical signal-to-air pressure transducer 42. The soft air push interval lasts, illustratively, from time equals 35 seconds to time equals 48 seconds. At the end of this time interval (at time equals 48 seconds), the target 22 has completely passed device 20, and relatively little of the first coating material remains in feed tube 18. Valves 56, 62 open and provide a combined solvent and high-pressure air flush at about 60 p.s.i.a. ($4.13\times10^6$ dynes/cm$^2$). Then, at time equals 56 seconds (time equals 0 seconds of the next cycle), valves 56, 62 close, terminating the flows of solvent and high-pressure air. Low-pressure air is again supplied to low-pressure line 40 at the pressure required for the dispensing of a second color at the same rate as the first color was dispensed.

In the cycles illustrated in FIG. 2, the second color is slightly more viscous and requires a slightly higher pressure in line 40 of approximately 30 p.s.i.a. ($2.07\times10^6$ dynes/cm$^2$) to maintain this constant delivery rate through manifold 14 and feed tube 18 to device 20. At time equals 91 seconds (time equals 35 seconds of the second color dispensing cycle), the pressure control valve 16*a–j* for the second color is closed, and valve 50 is opened, supplying soft air at a slightly higher pressure to push the remainder of the second color from manifold 14 through feed tube 18 toward device 20. A slightly higher pressure declining value "ramp" signal maintains the flow rate of the second coating material substantially constant to device 20 and assures that the quality of the finish dispensed on the target being coated is maintained uniform during the time period from the beginning of the soft air push to the beginning of the next color change purge cycle beginning at time equals 104 seconds (time equals 48 seconds of the second color change cycle).

Figure 3:
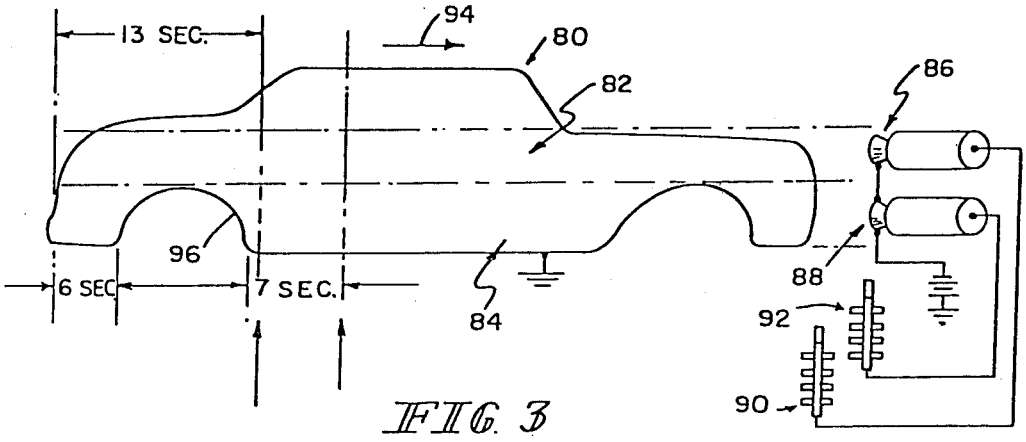
FIG. 3 is a highly diagrammatic illustration of a typical two-atomizer installation illustrating aspects of a color-change cycle.

Another aspect of the invention is best illustrated in FIG. 3. In FIG. 3, a typical target to be coated, a vehicle body 80, is divided into an upper zone 82 and a lower zone 84. The coating of the upper zone 82 is predominantly controlled by an upper atomizing and dispensing device 86. The coating on the lower zone 84 is predominantly controlled by a lower atomizing and dispensing device 88. Each device is fed from coating material sources (not shown) through a respective color change manifold 90, 92. The vehicle body 80 is moving in the direction of arrow 94 past the relatively stationary devices 86, 88 on a conveyor (not shown). Because of the existence of the rear wheel well 96, the soft air pushes of coating material to devices 86, 88 must be initiated at different times. Specifically, the soft air push for device 88 must begin about 7 seconds (in a typical case) before the rear wheel well 96 will appear before device 88, since the supply of coating material to device 88 will be substantially completely cut off by turning off soft air to manifold 92 during the approximately 7 second time interval that the wheel well 96 itself is before device 88. During the 7 second time interval that device 88 is not dispensing coating material because of the presence of the wheel well, device 86 will continue to dispense coating material, for example in accordance with the signal illustrated in FIG. 2, so that zone 82 above wheel well 96 will be satisfactorily coated. Then, beginning at the rear edge of wheel well 96, device 88 will again be supplied with coating material by triggering on the soft air push for an additional 6 seconds so that the back of the vehicle body 80 rear quarter panel in lower zone 84 will be satisfactorily coated. The soft air push for the device 86, on the other hand, begins 13 seconds before the rear end of the vehicle body 80 passes devices 86, 88 (substantially at the leading edge of the rear wheel well 96), and continues until the rear end of the vehicle body 80 passes devices 86, 88.

Under certain circumstances, problems can attend the use of variable soft air to conduct the push as just described. One such problem associated particularly with the variable low pressure air pushing of more highly conductive coating materials can best be appreciated by referring to FIG. 4.

Figure 4:
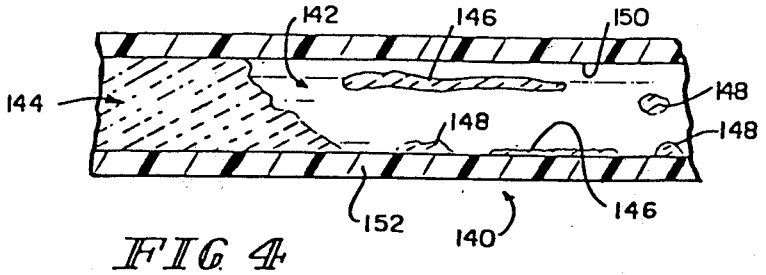
FIG. 4 is a fragmentary longitudinal sectional view of a coating material delivery tube.

In FIG. 4, a variable low pressure soft air push is being conducted through a delivery tube 140 illustrated in cross section. As the region 142 on the right of FIG. 4 empties of coating material 144 under the influence of soft air in region 142, small tracks 146 and pools 148 of coating material remain on the delivery tube 140 inner wall surface 150. It must be remembered that in a coating material atomizing operation which is electrostatically aided, the column of coating material 144 will be at some potential between the typically high magnitude (e.g., −100 KVDC) potential of the atomizing device (see FIG. 1, device 20 and FIG. 3, devices 86, 88) and ground, owing to the direct coupling of the column of coating material 144 inside delivery tube 140 to the atomizing device. Thus, as the column breaks up forming the tracks 146 and pools 148, arcing typically can occur between and among the various tracks 146 and pools 148 which are at different electrical potentials.

A number of hazards are immediately apparent. Typically, the coating material vapors, solvent vapors, and the like in region 142, mixed with the soft air, are combustible. Additionally, the presence of electrical discharges within the tube 140 and adjacent wall surface 150 promotes or aggravates harmful chemical activity in the otherwise relatively chemically inert material from which delivery tube 140 is ordinarily constructed. This can result in minute "pinholes" forming in the wall 152 material. This, of course, raises the possibility of leakage of coating materials and solvents through the pinholes. Since the coating materials are frequently at potentials other than ground, the possibility of grounding the column of coating material 144 to articles on the outside of tube 140 adjacent such pinholes arises.

As described above, a typical color-change cycle involves flushing of the delivery tube 140 with solvent. Thus, in this second embodiment of the invention, the variable low pressure push of the tail or slug of coating material prior to the initiation of a color-change cycle is conducted using the solvent which will be used during the flushing portion of the cycle, rather than the low pressure air. This has several advantages. First, since the column of coating material is followed by a column of solvent, there is no danger of arcing among the various tracks 146 and pools 148, the presence of which was attributable to the soft air pushing the tail of coating material. Thus, the use of a soft solvent push as taught by this embodiment enhances the safety of the system in this regard. An attendant benefit is that, since there are no open arcs adjacent wall surface 150, the likelihood of pinholing of the delivery tube wall 152 is significantly reduced. Therefore, so is the risk of leakage of coating materials and solvents through such pinholes. Safety of the system is enhanced from this standpoint also.

An added significant benefit can be understood by recognizing that the delivery tube 140 must be flushed with the solvent during the color-change cycle anyway. Use of the same solvent material for the soft solvent push and for flushing permits a much faster color-change cycle to be used.

With reference to FIG. 2, it will be recalled that in certain situations, it is necessary to reduce the soft air pressure fairly steadily from the beginning to the end of the soft air push to account for the decreasing drag of the steadily decreasing tail or slug of coating material being pushed from the delivery tube to the atomizing device. This is necessary to ensure a relatively steady delivery rate of coating material from the slug to the atomizing device during the push. With the soft solvent push of the second embodiment, this steadily decreasing "ramp" of soft solvent pressure adjustment will be necessary in far fewer cases than it is when air is used for the soft push. This is so because the drag of the solvent used to perform the soft solvent push typically much more closely approximates the drag of the coating material against the delivery tube walls than does the drag of air when air is used for the soft push.

Figure 5:
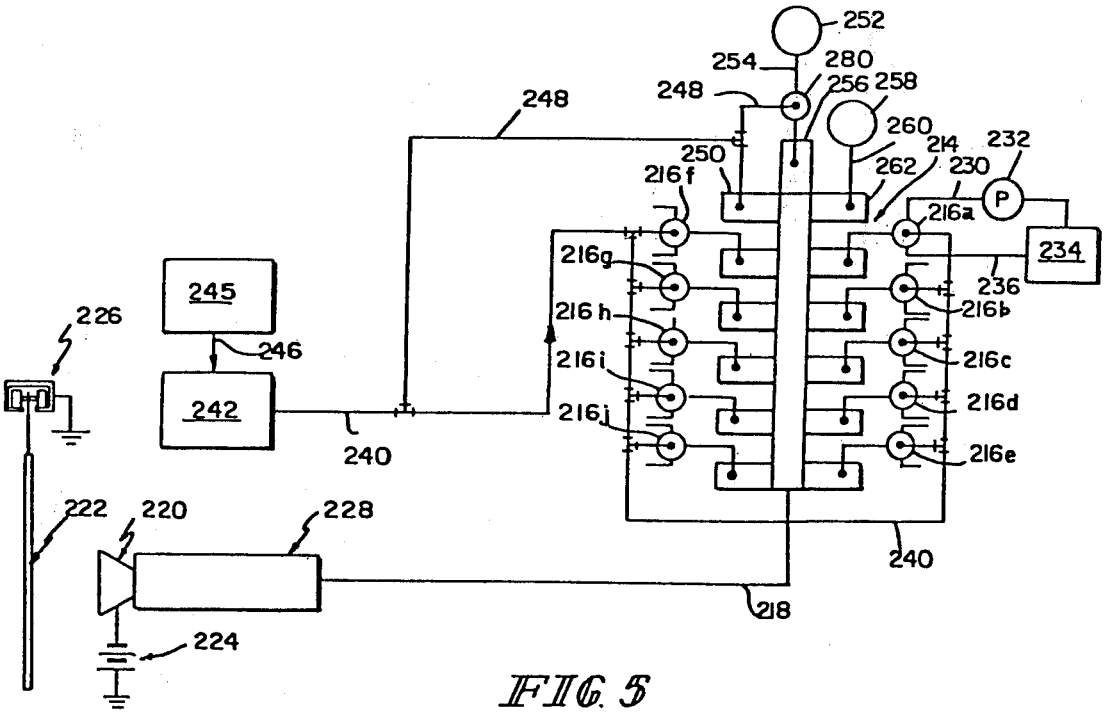
FIG. 5 is a partly block and partly schematic diagram of a single atomizing device and associated coating material color control system for dispensing any one of ten different coating materials having different characteristics.

Turning now to FIG. 5, a delivery system employing a soft solvent push will be explained in somewhat greater detail. A ten-color manifold 214 controls the flow of coating materials from each of ten different sources (only one of which is shown) through ten independently operated pressure control valves 216*a–j* to a single feed tube 218. Feed tube 218 is coupled to the atomizing and dispensing device 220. From device 220, a selected one of the ten colors is dispensed and deposited upon a target 222 to coat it.

Again, the atomizing and dispensing device 220 is typically held at a high-magnitude potential by an electrostatic potential supply 224. Targets 222 are conveyed serially past the stationary, or relatively stationary, atomizing and dispensing device 220 on conveyors 226.

Each of valves 216*a*–216*j* includes a coating material delivery line 230 which is coupled through a pump 232 to a coating material source 234. Each valve 216*a–j* also includes a recirculating line 236 through which coating material delivered through line 230 by pump 232 from source 234 is recirculated to source 234 when the valve 216*a–j* is in the recirculate position. Although only one delivery system 230, 232, 234, 236 for coating material to a valve (216*a*) is shown, it is understood that each of valves 216*a–j* has such a system for a different coating material associated with it.

The pressures of the various coating materials delivered from the various sources 234 to the various valves 216*a–j* are regulated through a common low-pressure air line 240 from an electrical signal-to-air pressure transducer and volume booster 242.

The input signal to electrical signal-to-air pressure transducer and volume booster 242 is provided by an electrical signal output of a program control device 245. Device 245 is programmed to provide electrical output signals which actuate respective valves 216*a–j* in accordance with the desired coating materials to be dispensed upon respective targets 222 as the targets are conveyed along the conveyor 226 past device 220. In addition to providing this electrical control of valves 216*a–j*, the program control device includes stored information relative to the characteristics of each of such coating materials, and calls up the stored information relative to the characteristics of a particular coating material dispensed by a particular valve 216*a–j*, as that particular valve 216*a*–216*j* is actuated to dispense its respective coating material. This information relative to characteristics appears as a direct-current electrical signal on line 246. The different DC voltage levels appearing on line 246 correspond to respective different pressures in low-pressure air line 240 and different pressures in the coating materials dispensed from respective valves 216*a–j* into the ten-color manifold 214.

Slightly before the target 222 to be coated has passed device 220, and a color change is to be made, solvent from a solvent supply 252 is provided through a solvent supply line 254 and a solvent supply valve 256 to manifold 214 to flush any coating material remaining in manifold 214, feed tube 218, and device 220 from these components so that this color will not contaminate the next color to be dispensed through manifold 214. So that the solvent does not affect the viscosity of the next coating material, particularly during the early stages of the dispensing process for the next coating material, the solvent is dried using high-pressure air provided by a supply 258 through a high-pressure air supply line 260 and a high-pressure air supply valve 262 on manifold 214.

Figure 6:
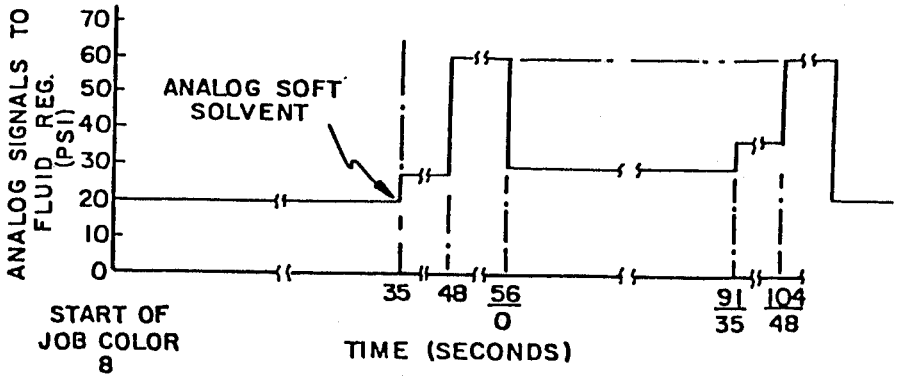
FIG. 6 is a time chart which illustrates portions of typical color-change cycles.

An example of a color-change cycle with the system illustrated in FIG. 5 is illustrated in FIG. 6. During the time interval from 0 to 35 seconds, a first color is being dispensed at a line 240 pressure of about 20 p.s.i.a. ($1.38\times10^6$ dynes/cm$^2$). Toward the end of the interval during which the first color is to be dispensed, valve 256 is actuated and solvent at about the same pressure is supplied through line 254 to push the end of the first color from manifold 214 through feed tube 218 to device 220. The rate of flow of the first coating material is maintained substantially constant throughout this interval, even though no more coating material is being supplied through a respective valve 216*a–j* to manifold 214. As previously outlined, although the remaining "slug" of coating material in the feed tube 18 is becoming continuously smaller, reducing its resistance to flow, this substantially constant flow can be achieved in many cases without employing a "ramp" solvent pressure. Occasionally, however, it may be necessary to employ a ramp solvent signal not unlike the ramp air signal illustrated in FIG. 2. Whether or not such a ramp or "staircase" or other declining value solvent pressure must be used depends upon factors such as how closely the solvent flow characteristics match those of the various coating materials being dispensed. The solvent pressure is controlled through a pressure control valve 280 which is similar in construction and operation to valves 216*a–j*. The soft solvent push interval lasts, illustratively, from time equals 35 seconds to time equals 48 seconds. At the end of this time interval (at time equals 48 seconds), the target 222 has completely passed device 220, and relatively little of the first coating material remains in feed tube 218. Valves 256, 262 open and provide a combined solvent and high-pressure air flush at about 60 p.s.i.a. ($4.13\times10^6$ dynes/cm$^2$). Then, at time equals 56 seconds (time equals 0 seconds of the next cycle), valves 256, 262 close, terminating the flows of solvent and high-pressure air. Low-pressure air is again supplied through low-pressure line 240 at the pressure required for the dispensing of a second color at the same rate as the first color was dispensed.

In the cycles illustrated in FIG. 6, the second color is slightly more viscous and requires a slightly higher pressure in line 240 of approximately 30 p.s.i.a. ($2.07\times10^6$ dynes/cm$^2$) to maintain this constant delivery rate through manifold 214 and feed tube 218 to device 220. At time equals 91 seconds (time equals 35 seconds of the second color-dispensing cycle), the pressure control valve 216*a–j* for the second color is closed, and valve 256 is opened, supplying soft solvent to push the remainder of the second color frame manifold 214 through feed tube 218 toward device 220. The soft solvent pressure, controlled through valve 280 which is coupled to the low-pressure air line 248, maintains the flow rate of the second coating material substantially constant to device 220 and assures that the quality of the finish dispensed on the target being coated is maintained uniform during the time period from the beginning of the soft solvent push to the beginning of the next color change cycle beginning at time equals 104 seconds (time equals 48 seconds of the second color change cycle).

It should further be understood that the soft solvent push technique can be readily adapted to the application technique discussed in connection with FIG. 3, with soft solvent replacing soft air.

Figure 7:
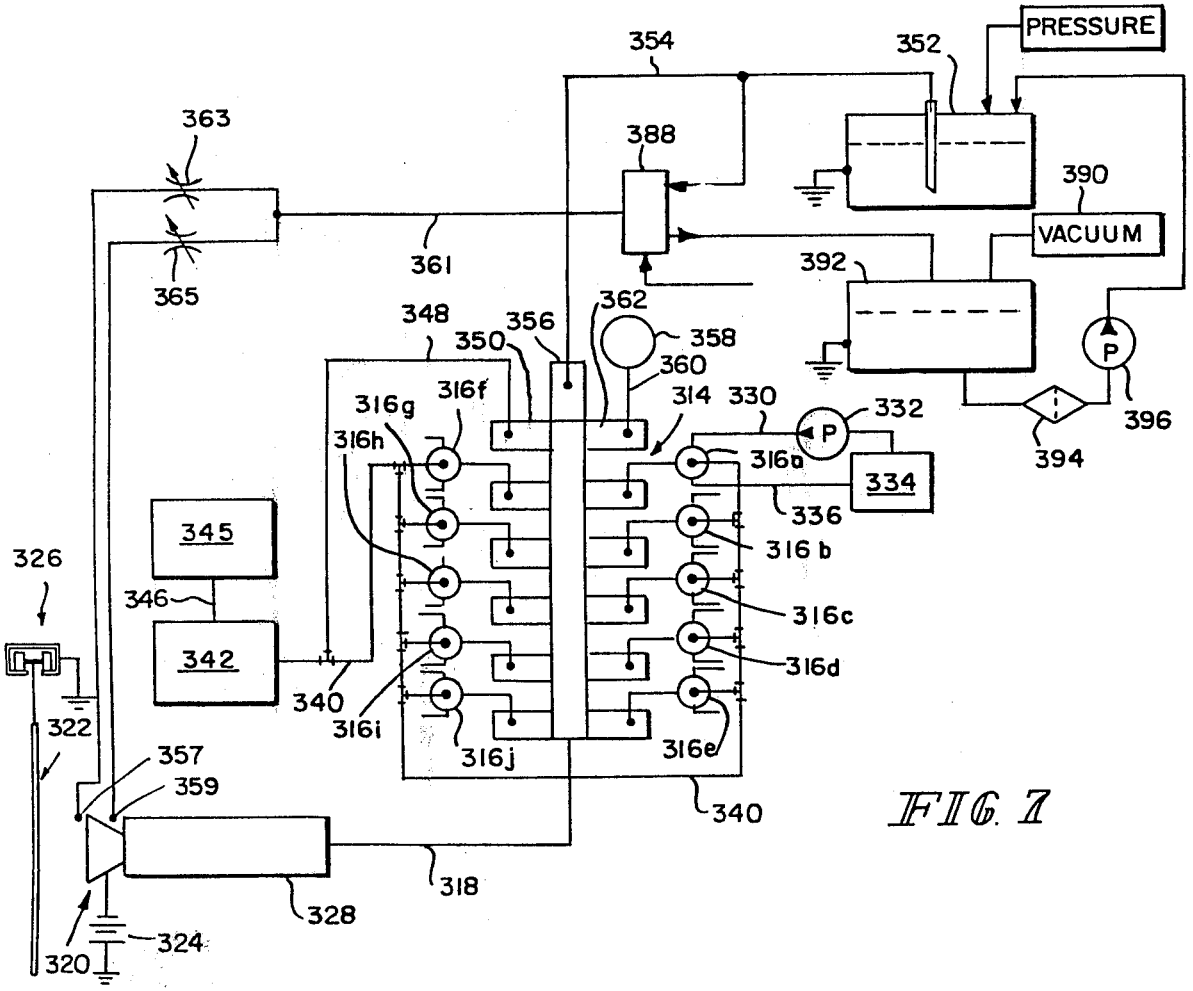
FIG. 7 is a partly block and partly schematic diagram of a single atomizing device and associated coating material color control system for dispensing any one of ten different coating materials having different characteristics.

With reference to FIG. 7, it will be recalled that in all of the previous discussions, it was necessary to flush the feed tube at some point with a solvent to dissolve and flush from the feed tube any remaining pre-change color to prevent the pre-change color from contaminating the color dispensed after the color change. In each case, this necessitated following the solvent flush with a "blow down" or drying of the remaining solvent from the feed tube so that no solvent was left to affect the characteristics (e.g., viscosity) of the color to be dispensed after the color change. Thus, the feed tube and the color change manifold were filled with solvent, flushed, and dried during each color change cycle. This was done although, in most cases, only the first several inches or centimeters of the solvent following the slug of pre-change color were contaminated by the pre-change color and the rest of the solvent in the manifold and feed tube was essentially uncontaminated by the pre-change color.

Turning now to FIG. 7, a delivery system employing uncontaminated purge solvent recovery will be discussed. A ten-color manifold 314 controls the flow of coating material from each of ten different sources (only one of which is shown) through ten independently operated pressure control valves 316*a–j* to a single feed tube 318. Feed tube 318 is coupled to the atomizing and dispensing device 320. From device 320, a selected one of the ten colors is dispensed and deposited upon a target 322 to coat it.

Again, the atomizing and dispensing device 320 is typically held at a high-magnitude potential by an electrostatic potential supply 324. Targets 322 are conveyed serially past the stationary, or relatively stationary, atomizing and dispensing device 320 on conveyors 326.

Each of valves 316*a*–316*j* includes a coating material delivery line 330 which is coupled through a pump 332 to a coating material source 334. Each valve 316*a–j* also includes a recirculating line 336 through which coating material delivered through line 330 by pump 332 from source 334 is recirculated to source 334 when the valve 316*a–j* is in the recirculate position. Although only one delivery system 330, 332, 334, 336 for delivering coating material to a valve (316*a*) is shown, it is is understood that each of valves 316*a–j* has such a system for a different coating material associated with it.

The pressures of the various coating materials delivered from the various sources 334 to the various valves 316*a–j* are regulated through a common low-pressure air line 340 from an electrical signal-to-air pressure transducer and volume booster 342.

The input signal to electrical signal-to-air pressure transducer and volume booster 342 is provided by an electrical signal output of a program control device 345. Device 345 is programmed to provide electrical output signals which actuate respective valves 316*a–j* in accordance with the desired coating materials to be dispensed upon respective targets 322 as the targets are conveyed along the conveyor 326 past device 320. In addition to providing this electrical control of valves 316*a–j*, the program control device includes stored information relative to the characteristics of each of such coating materials, and calls up the stored information relative to the characteristics of a particular coating material dispensed by a particular valve 316*a–j*, as that particular valve 316*a–j* is actuated to dispense its respective coating material. This information relative to characteristics appears as a direct current electrical signal on line 346. The different DC voltage levels appearing on line 346 correspond to respective different pressures in low-pressure air line 340 and different pressures in the coating materials dispensed from respective valve 316*a–j* into the ten-color manifold 314.

Slightly before the target 322 to be coated has passed device 320, and a color change is to be made, solvent from a solvent supply 352 is provided through a solvent supply line 354 and a solvent supply valve 356 to manifold 314 to flush any coating material remaining in manifold 314, feed tube 318, and device 320 from these components so that this color will not contaminate the next color to be dispensed through manifold 314. Such systems also frequently include cleaning jets 357, 359 for spraying solvent onto the hub and the outside surfaces, respectively, of the atomizing device 320. Jets 357, 359 are supplied with solvent from tank 352 through a line 361 and adjustable flow regulators 363, 365, respectively. A pilot signal is provided by the program control device 345, e.g., through an intervening electrical signal-to-air signal transducer (not shown), to the pilot input port of a valve 388 which switches off the flow of solvent from solvent supply 352 and switches on vacuum in line 361 from a vacuum source 390 over a purge solvent recovery tank 392. This withdraws uncontaminated purge solvent remaining in jets 357, 359, and line 361 into tank 392. From tank 392, this recovered usable solvent can be returned to supply 352 through any suitable means, such as a filter 394 and pump 396. The recovery of the solvent from line 361 achieves economy in the use of solvent and also minimizes the likelihood of solvent dripping from jets 357, 359 during the next coating operation. Such dripping is to be avoided, particularly in overhead atomizers since, if the jets associated with overhead atomizers drip solvent, the drips can land on the articles, e.g., car bodies, being finished. This can result in damage to the finishes on such car bodies and cause additional finish repair to become necessary.

Figure 8:
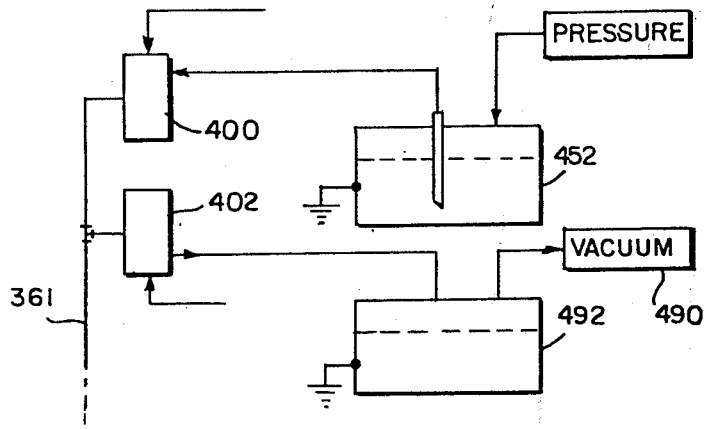
FIG. 8 is a partly block and partly schematic diagram of a detail of a modification of the system of FIG. 7.

In another embodiment of the invention illustrated in FIG. 8, pilot valve 388 is replaced by two separate pilot valves, one, 400, of which controls the flow of solvent from a solvent supply 452 to jets and a jet supply line (not shown) like those illustrated in FIG. 7. The other, 402, of the pilot valves controls the vacuum recovery of substantially uncontaminated solvent from the jets and jet supply line to a tank 492 by a vacuum source 490 over the solvent in tank 492.

What is claimed is:

1. An apparatus for terminating the flow of a coating material in a coating material delivery system which delivers the coating material to a dispensing device from which the material is dispensed during a coating operation and from which flow of the material ceases at the end of the coating operation, the apparatus including means for terminating the flow of coating material to the dispensing device, means for initiating and terminating the flow of a fluid cleaning medium to the dispensing device, and means for establishing a partial vacuum on the remaining cleaning medium.

2. Apparatus for cleaning a coating material atomizing device which is supplied with coating material from a coating material supply, including a delivery conduit for delivering coating material to the device and a controller for controlling the supply of coating material to the delivery conduit, means for halting the flow of coating material to the delivery conduit, means for sequentially starting and halting the flow of a fluid cleaning medium to the atomizing device, and means for establishing a partial vacuum on the remaining cleaning medium.

3. Apparatus for terminating the flow of a coating material to a dispensing device from which the material is dispensed during a coating operation and from which flow of the material ceases at the end of the coating operation including means for terminating the flow of coating material to the dispensing device, means for initiating and halting the flow of a fluid cleaning medium to the dispensing device, and means for establishing a partial vacuum on the fluid cleaning medium.

4. Apparatus for cleaning a coating material atomizing device supplied with coating material from a coating material supply system including a delivery conduit for delivering coating material to the device and a controller for controlling the supply of coating material to the delivery conduit, including means for halting the flow of coating material to the delivery conduit, means for starting and halting, sequentially, the flow of a fluid cleaning medium to the atomizing device, means for establishing a partial vacuum on the unused fluid cleaning medium, and means for receiving the thus-recovered unused cleaning medium.

5. Apparatus for changing coating material colors being dispensed in a dispensing device for dispensing the various coating material colors, the apparatus comprising means for terminating the supply of coating material of a pre-change color to the dispensing device, means for initiating and halting the flow of a fluid cleaning medium to the dispensing device, and means for establishing a partial vacuum on the unused cleaning medium to recover it.

* * * * *